US007642893B2

(12) United States Patent
Gasse et al.

(10) Patent No.: US 7,642,893 B2
(45) Date of Patent: Jan. 5, 2010

(54) ARRAY OF INDEPENDENTLY-ADDRESSABLE RESISTORS, AND METHOD FOR PRODUCTION THEREOF

(75) Inventors: Adrien Gasse, Grenoble (FR); Guy Parat, Claix (FR)

(73) Assignee: Commissariat a L'Energie Atomique, Paris (FR)

( * ) Notice: Subject to any disclaimer, the term of this patent is extended or adjusted under 35 U.S.C. 154(b) by 667 days.

(21) Appl. No.: 10/574,257

(22) PCT Filed: Oct. 1, 2004

(86) PCT No.: PCT/FR2004/050476

§ 371 (c)(1),
(2), (4) Date: Mar. 30, 2006

(87) PCT Pub. No.: WO2005/034148

PCT Pub. Date: Apr. 14, 2005

(65) Prior Publication Data

US 2007/0247274 A1 Oct. 25, 2007

(30) Foreign Application Priority Data

Oct. 3, 2003 (FR) ..... 03 50651

(51) Int. Cl.
*H01C 13/00* (2006.01)

(52) U.S. Cl. ..... 338/215; 338/13; 338/24; 347/58; 347/61

(58) Field of Classification Search ..... 338/215, 338/13–14, 24, 131, 198; 347/55, 57, 58, 347/61–62, 68

See application file for complete search history.

(56) References Cited

U.S. PATENT DOCUMENTS

| | | | | |
|---|---|---|---|---|
| 4,803,457 | A | 2/1989 | Chapel, Jr. et al. | |
| 5,612,664 | A * | 3/1997 | Hilgenberg et al. | 338/295 |
| 5,653,939 | A * | 8/1997 | Hollis et al. | 506/3 |
| 5,781,211 | A | 7/1998 | Bobry | |
| 6,139,126 | A * | 10/2000 | Ayata et al. | 347/13 |
| 6,309,053 | B1 * | 10/2001 | Torgerson et al. | 347/59 |
| 6,958,648 | B2 * | 10/2005 | Cheung et al. | 330/86 |
| 6,994,030 | B2 | 2/2006 | Perut et al. | |
| 2002/0048765 | A1 | 4/2002 | Shao et al. | |
| 2003/0059807 | A1 | 3/2003 | Roach et al. | |
| 2003/0186295 | A1 | 10/2003 | Colin et al. | |
| 2004/0144242 | A1 | 7/2004 | Perut et al. | |

FOREIGN PATENT DOCUMENTS

| | | |
|---|---|---|
| EP | 0 813 088 | 12/1997 |
| EP | 1 188 840 | 3/2002 |
| FR | 2 828 244 | 2/2003 |
| GB | 2 031 805 | 4/1980 |
| WO | WO 02/18823 | 3/2002 |

* cited by examiner

*Primary Examiner*—Kyung Lee
(74) *Attorney, Agent, or Firm*—Brinks Hofer Gilson & Lione

(57) ABSTRACT

The arrays of independently-addressable resistors are commonly used to control miniature elements. The invention proposes solving the problem caused by the loss of power dissipated in the addressed resistor by choosing, for this resistor, a material with a negative thermal coefficient resistance, which enables the addressing output of this resistor to be increased.

13 Claims, 2 Drawing Sheets

ARRAY OF INDEPENDENTLY-ADDRESSABLE RESISTORS, AND METHOD FOR PRODUCTION THEREOF

TECHNICAL FIELD

This invention relates to arrays of passive components, and more specifically to resistors mutually connected by lines and columns, as well as the production thereof. These resistor arrays can be used in various fields, in particular to activate components by the Joule effect.

PRIOR ART

To reduce the space requirement and weight of command systems, resistor arrays have been developed in which a large number of resistive elements are condensed on a small surface, while remaining individually activatable.

As shown in FIG. 1, a resistor array comprises N lines of commands (indices $N_i$, with i being strictly a positive integer), M columns of commands (indices $M_j$, with j being strictly a positive integer), and NM resistors (indices $R_{ij}$, with each resistor. $R_{ij}$ being commanded by line $N_i$ and column $M_j$). To control a resistor, the switches of its lines and columns are "closed": for example, the voltage "+V" can be applied to line $N_i$ and "0" to column $M_j$; the resistor $R_{ij}$ is then "addressed", i.e. subjected to a current, unlike the others.

Regardless of the use of these arrays, one of the issues is to precisely localise the control power on a predetermined resistor so as to achieve the expected effect by the command, while reducing the dissipated power in the other elements of the array, in particular the resistors, due to the induced or drift currents, both in order to increase the power in the resistor addressed and so that the command remains specific.

Indeed, the maximum power is dissipated in the resistor addressed. However, there are also other non-zero currents circulating in the lines and columns, as well as in the other resistors, which also induce power losses in and by these elements. This means that the command power is not entirely dissipated in the resistor addressed (loss of efficacy) and that the non-addressed resistors also dissipate an undesirable power (loss of sensitivity). Simulations have thus shown that for a 150-point array, for example, around 15% of the power is dissipated at the point addressed, while the other points where the dissipated power is higher release around 5% of the power.

One of the known means for overcoming these effects involves coupling each resistor to a diode or a switch so as to block the current in the non-addressed resistors. However, this solution is very problematic because it involves doubling each resistor, which leads to high production costs and a detrimental loss of compactness.

Another technique would be to segment the array into subunits so that the power loss is reduced, enabling the number of diodes to be reduced. This solution does not eliminate the problems of complexity specific to the diodes, or the unwanted residual heating in each of the arrays.

Another alternative consists of commanding each line and column with voltages that are adjusted and controlled by a control system. This makes it possible to precisely control the residual power in the non-addressed resistors and to modify the parameters. Although this solution is effective, it clearly requires an expensive command control system that is difficult to implement.

DESCRIPTION OF THE INVENTION

The invention aims to propose a simple solution that overcomes the disadvantages inherent to the existing solutions, for producing a resistor array enabling the power to be localised on one of the resistors of the array while limiting the power dissipated in the rest of the array. This resistance thermally activates an associated component.

More specifically, one of the aspects of the invention relates to the choice of thermal properties of at least one resistor, so as to increase its addressing output, i.e. the power dissipated by this resistor with respect to the total power dissipated, which power enables an associated component to be thermally activated. This resistor (or these resistors) is thus chosen so that it has a negative thermal coefficient resistance, i.e. the resistance value decreases with its temperature. During its use, by releasing power, the temperature of the resistant element increases; according to the invention, the resistance value will then decrease, and its power will therefore increase to a constant voltage during the heating. The precision of the activation of associated components is thus increased.

The invention thus relates to a resistor array in which one of the resistors has a negative thermal coefficient resistance and is associated with a thermally-activatable component. These negative thermal coefficient resistors are advantageously made of a single material having this property, which significantly simplifies the production process.

An example of a preferred embodiment relates to an array in which all of the resistors have negative thermal coefficient resistances, and in particular are identical. Indeed, regardless of the array, the power released in the non-addressed resistors is lower than the power dissipated at the point addressed. The temperature of the addressed resistor therefore increases faster than the temperature of the rest of the circuit: even if all of the resistors have negative thermal coefficient resistances, and are identical, the value of the non-addressed resistors will decrease more slowly over time than that of the addressed resistor. There is an increase in the power released by the non-addressed resistors, but it is lower than the increase in the power dissipated by the addressed resistors. Therefore, this case also leads to an increase in output with respect to that of a conventional array.

The material used for certain, or even all, lines and columns, has a positive thermal coefficient, which leads to an increase in the resistance of these elements and therefore a decrease in lost power.

A plurality of resistors of the array according to the invention, or even all of them, can be coupled to components so as to activate them. The invention also relates to a device using this array, such as a biochip or a reaction card.

To optimise its output, it is advantageously possible to adjust, for example, with a programmable pulse generator, the time for which a command voltage is applied to a resistor.

The invention also relates to the method for producing a resistor array in which one resistor, associated with a thermally-activatable component, is made of a material placed, for example by deposition, on a substrate, which material has a negative thermal coefficient resistance.

BRIEF DESCRIPTION OF THE DRAWINGS

The invention can be better understood with the following figures, which are provided for the sole purpose of illustrating the invention, and are in no way limiting.

DETAILED DESCRIPTION OF SPECIFIC EMBODIMENTS

As described above, FIG. 1 shows a conventional array or resistors that are individually addressable, including N lines, M columns and NM resistors. These resistors can be controlled simultaneously, successively or by a combination of these two modes.

The resistor $R_{ij}$ is addressed, and dissipates a power $P_{ij}$:

$$P_{ij} = \frac{U^2}{R_{ij}},$$

with U voltage at the terminals. The power $P_{ij}$ can be used in particular to thermally activate a component associated with the resistor $R_{ij}$.

The output $Q_{ij}$ of the addressed resistor $R_{ij}$ is equal to the power $P_{ij}$ relative to the total power released. However, the other elements of the array also react to the addressing voltage: an example of an induced current is thus shown with a dotted line, which, in this configuration, leads to a release of power in particular by the resistors $R_{i+1,j}$, $R_{i+1,j+1}$, $R_{i,j+1}$, $R_{i,j+2}$, as well as by the segments of lines and columns separating them. These parameters are to be taken into consideration when the output is evaluated.

In addition, any power dissipation is accompanied by heating of the resistor concerned and an increase in its temperature. The temperature of the addressed resistor increases more quickly than that of the other elements.

Figure 2A:
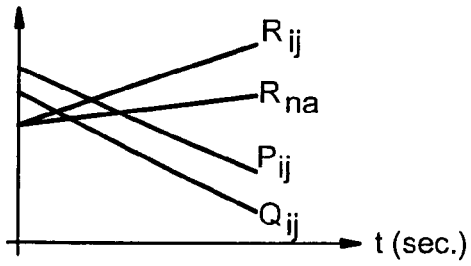
FIG. 2: change over time of various parameters during use of a positive thermal coefficient resistor array (FIG. 2*a*) and a negative thermal coefficient resistor array (FIG. 2*b*)

However, in conventional materials for producing resistors, the resistance increases when the temperature increases: see the curve $R_{ij}$ of FIG. 2*a*. The power dissipated by the resistor $R_{ij}$ (curve $P_{ij}$) will therefore decrease over time, more rapidly than the power released by the other resistors, of which the temperature and the resistance (curve $R_{na}$) increase less quickly. The output of the addressed resistor $R_{ij}$ therefore decreases as it is activated (curve $Q_{ij}$), and the increase in temperature, which is the desired objective of command arrays for Joule heating of elements, slows.

In the context of the invention, to produce the resistance $R_{ij}$, a material of which the resistance decreases with the temperature, i.e. a negative thermal coefficient resistance, or NTCR, is used. This material can be one of the components of a resistor, or the resistor can be made entirely of such a material. Examples of this are tantalum nitride, nickel-chromium alloys, or nitrides from refractory materials. The thermal coefficient (TCR) can be adjusted, either by combining materials or by the parameters selected when producing the resistor. Depending on the requirements, the NTCR can thus vary from −100 to −3000 ppm/° C.

Figure 2B:
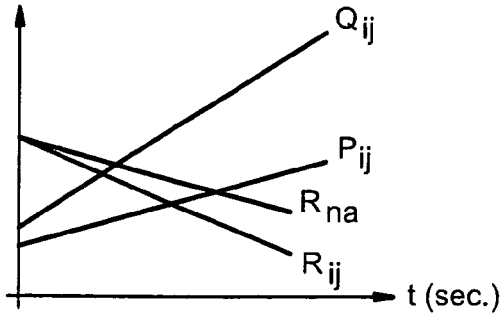

In the case of a NTCR array shown in FIG. 2*b*, over time, the energy dissipation by the addressed resistor $R_{ij}$ increases with its temperature, its resistance (curve $R_{ij}$) decreases, and therefore its dissipated power (curve $P_{ij}$) correspondingly increases.

It is also noted in FIG. 2*b* that, if all of the resistors are NTCR, the resistances of the other negative thermal coefficient resistors that are not addressed also decrease (curve $R_{na}$), but less so because the temperature changes more slowly, as the power that they release remains below the dissipated power $P_{ij}$. The output of the addressed resistor (curve $Q_{ij}$) therefore increases.

A combination of the two examples can be considered, in which the addressed resistor $R_{ij}$ has a negative thermal coefficient resistance, and the others $R_{na}$ have positive thermal coefficient resistances: the output $Q_{ij}$ of the point addressed would increase correspondingly (not shown), and in particular in greater proportions than in the case of an entirely NTCR array. Other combinations can be considered, for example with a line and/or a column that is only NTCR.

In addition, the resistor $R_{ij}$ is addressed by a command power that determines the voltage U at the terminals and the power $P_{ij}$ dissipated by this resistor.

A $P_{ij}$ modulation factor different from the value of each resistance is therefore the power "really" addressed to $R_{ij}$. This power is lower than the initial command power, with partial losses in the other resistors as described above, but also losses associated with the intrinsic resistance of the lines and columns.

It can therefore be advantageous to use a positive TCR material, such as aluminium or copper, for these lines and columns: by thermal conduction from the heated resistor, the material used in the lines and columns is capable of being heated. When a positive TCR material is used for these lines and columns, the resistance of the lines and columns will then increase, and the power lost in them will decrease, thus correspondingly increasing the power addressed, and similarly the output of the resistor addressed.

Figure 1:
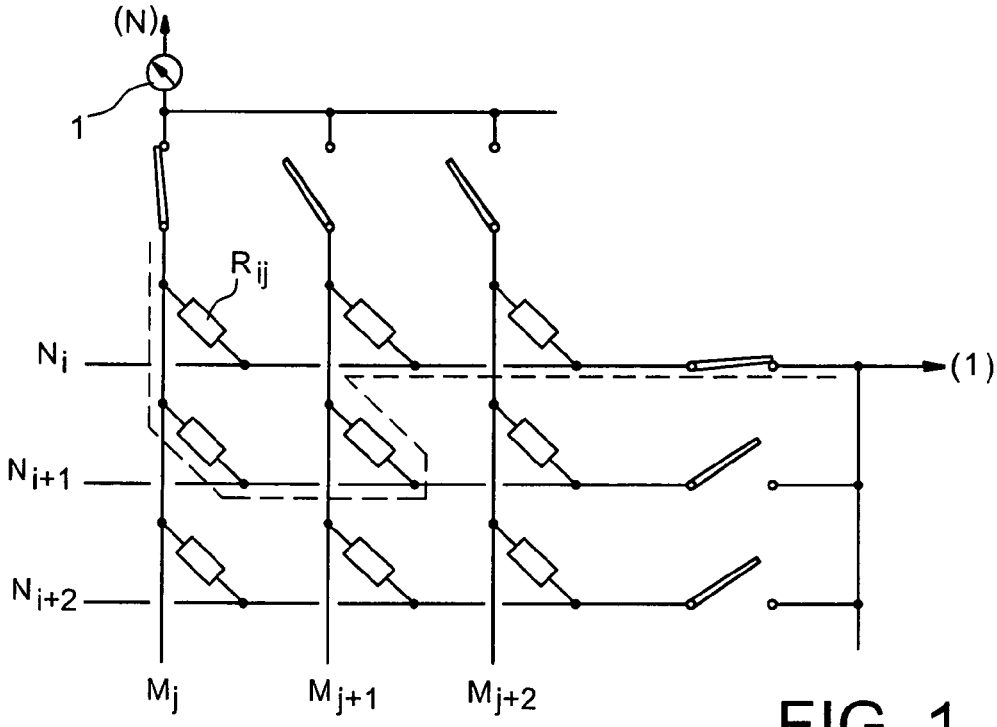
FIG. 1: diagram of a resistor array, with indication of an induced current.

The power addressed, and therefore the voltage at the terminals of the resistor addressed, can be modulated during use by adjusting the time for which this voltage is applied. This time parameter makes it possible to optimise the desired output for each addressed resistor $R_{ij}$, and the desired temperature for activating the component affected by this resistor. Indeed, the process enabling Joule heating is a dynamic phenomenon. Thus, the application of a voltage for a short time, for example 0.2 s, will make it possible to obtain moderate temperature increases, on the order of 100° C., and the application of the command for a longer time, for example 10 s, will lead to higher temperatures, on the order of 500° C. (see FIG. 2*b*). FIG. 1 shows an example of a pulse generator 1 connected to the lines and columns, which enables voltages of predetermined amplitude and time to be applied to the terminals of said lines (N) and columns.

EXAMPLE 1

An array of 144 resistors addressed by 12 lines and 12 columns, with heating resistances of 1000 ohms to be addressed and an interline and intercolumn resistance of 1 ohm, i.e. an intrinsic resistance of 1 ohm for each interconnection line and/or column.

By simulation, it has been found that for zero-temperature coefficient resistors, the power dissipated at the addressed point is 15% of the total power dissipated in the array, and the maximum power released by the other resistors is 4.5%.

If the resistors have a TCR of −2500 ppm/° C., when the temperature of the addressed resistor reaches 300° C., the other resistors will have reached a maximum of 100° C., and the power dissipated by the addressed resistor will be 40% of the total power instead of 15%, i.e. it will have more than doubled.

The array according to the invention therefore makes it possible to obtain very high temperatures, of 500° C. and above, in very localised points, for arrays that enable numerous points (50 to 1000 or more) to be addressed, and rapidly. It is possible to adjust the maximum necessary power by controlling the resistor TCR value. These effects are moreover possible without a diode or switch device, which would encumber the system, and the array can be produced on various types of substrates, by means of production methods not using heavy technology.

Indeed, to produce an array according to the invention, standard microelectronics technologies, in particular involving deposition and photolithographic etching, are preferably used. However, any other technique that can be used to produce microsystems can be considered: adhesive screen printing, adhesives, conductive or non-conductive polymers, screen printing pastes; ink jet technology, and so on.

Figure 3:
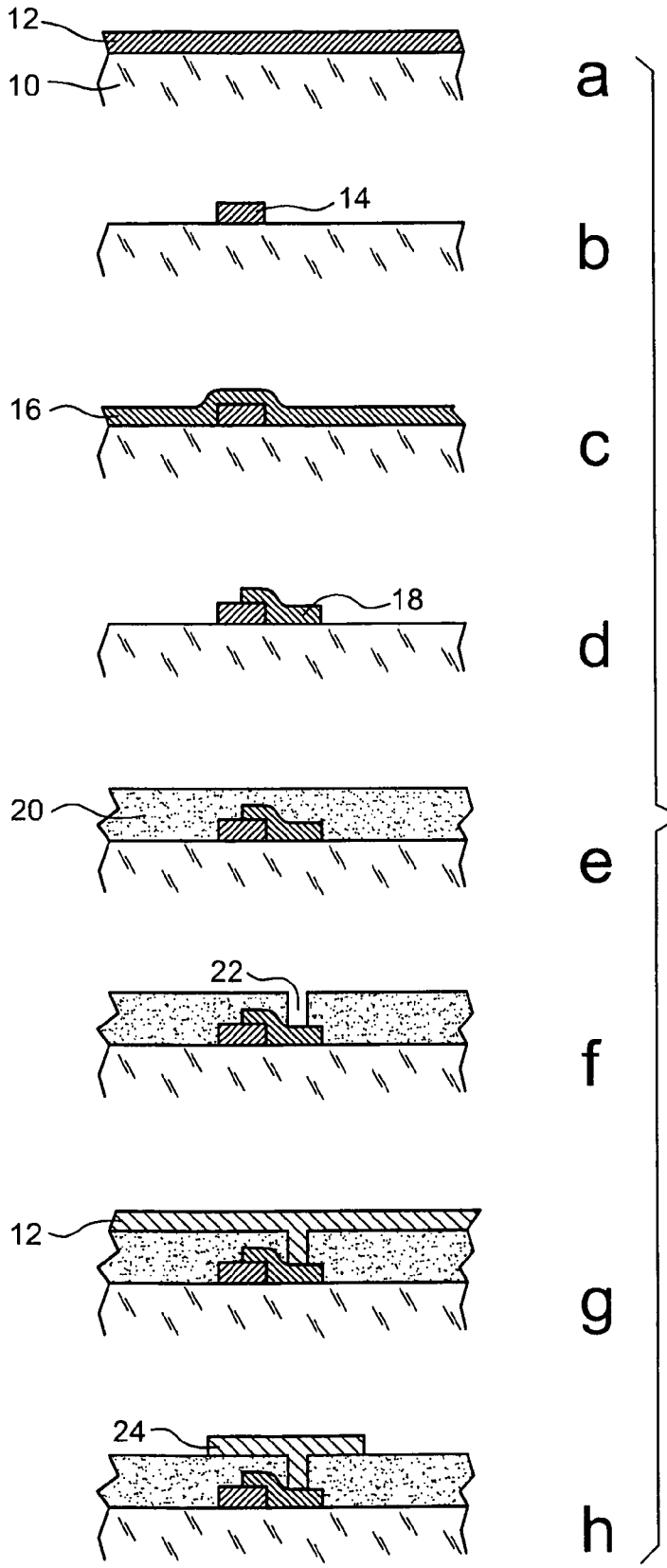
FIG. 3: synopsis, of an example of the production of a preferred array according to the invention.

FIG. 3 shows an example of a production method: a substrate 10 such as silicon is chosen. An aluminium layer 12 is deposited by cathode sputtering (FIG. 3*a*). Photolithography and chemical etching enable line patterns 14 to be produced (FIG. 3*b*). A layer of NTCR resistive material 16 is deposited by cathode sputtering (FIG. 3*c*); the resistive patterns 18 are produced by photolithography and etching (FIG. 3*d*). A dielectric layer 20 is then deposited so as to insulate the lines 14 and columns (FIG. 3*e*), with photolighography of the reconnection patterns 22 on the columns (FIG. 3*f*). Finally, an aluminium layer 12 is deposited by cathode sputtering (FIG. 3*g*), and the column patterns 24 are produced by photolithography and etching (FIG. 3*h*). The thermally-activatable components are associated using known techniques.

Typically, the aluminium layer 12 has a thickness of 500 to 50,000 Å, preferably 5000 Å; the thickness of the NTCR 16 is typically between 500 and 5000 Å, preferably 1000 Å. The NTCR can be adjusted preferably between −100 and −3000 ppm/° C. according to the deposition conditions and the desired parameters for use.

As a dielectric insulator 20, it is possible to use a polymer or a mineral such as $SiO_2$ or $Si_3N_4$. The substrate 10 is an insulating material and includes, for example, silicon, a polymer, glass, a ceramic material, etc., or a combination of these materials.

APPLICATION

The arrays according to the invention are applicable to a number of fields, such as, for example, biology, imaging or flat-panel displays, in which the command systems must be miniaturised. More specifically, the arrays according to the invention can be used to produce biochips or "Lab on Chips", also called reaction cards. Such a reaction card is known, for example, from document WO 02/18823. In general, we will henceforth refer to any structure capable of being used in biological applications, such as, for example, reaction cards or biochips, as device for biological use.

However, to produce such devices for biological use, a microfluidic array is integrated into the support card of the device: the liquid to be analysed must circulate, for example, between the various reagents. To cause a liquid to circulate in a microchannel array, microvalves are actuated.

Microvalves have been developed for applications in microsystems, biochips and reaction cards. An example of this is provided in document FR-A-2 828 244, which relates to pyrotechnically-actuated microvalves. The activation of the microvalves requires the localisation of heat below the microsystem, which is achieved, for example, by heating a resistor under each microvalve that will then be activated by the Joule effect.

For this preferred application, the microvalve array must be consistent, with a high density of the components to be activated: for example, 50 to 1000 microvalves over a surface typically on the order of the size of a credit card must be addressed individually. The use of resistor arrays therefore appears to be indicated.

The arrays according to the invention also have the advantage of optimising the output of each addressing, and therefore provide improved efficacy and specificity of the analyses performed.

The invention claimed is:

1. A resistor array comprising N lines of commands $N_i$, with i being a strictly positive integer, M columns of commands $M_j$, with j being a strictly positive integer, and NM resistors $R_{ij}$, each resistor $R_{ij}$ being commanded by the line $N_i$ and the column $M_j$, wherein at least one of the resistors $R_{ij}$ has a negative thermal coefficient resistance and is associated with a thermally activatable component, further comprising means for adjusting the time for which the command voltage is applied to at least one of the resistors $R_{ij}$, in particular to each resistor $R_{ij}$, so as to obtain the desired output.

2. The array according to claim 1, wherein each resistor $R_{ij}$ is associated with a thermally activatable component.

3. The array according to claim 1, wherein at least one of the activatable components is a microvalve.

4. The array according to claim 1, wherein all of the resistors $R_{ij}$ have negative thermal coefficient resistances.

5. The array according to claim 4, wherein all of the negative thermal coefficient resistors are made of a single material.

6. The array according to claim 1, wherein at least one of the negative thermal coefficient resistors is made of a single material.

7. The array according to claim 1, wherein all of the resistors are identical.

8. The array according to claim 1, wherein the negative thermal coefficient resistor includes tantalum nitride, a nickel-chromium alloy, or a nitride from refractory material.

9. The array according to claim 1, wherein the negative thermal coefficient resistor has a temperature coefficient of between −100 and −3000 ppm/° C.

10. The array according to claim 1, wherein the material used for at least one line and/or at least one column has a positive thermal coefficient resistance.

11. The array according to claim 10, wherein all of the lines and/or all of the columns are made of a material with a positive thermal coefficient resistance.

12. The array according to claim 11, wherein all of the lines and all of the columns are made of the same material.

13. The array according to claim 1, which is associated with an insulating substrate.

* * * * *

UNITED STATES PATENT AND TRADEMARK OFFICE

CERTIFICATE OF CORRECTION

PATENT NO. : 7,642,893 B2
APPLICATION NO. : 10/574257
DATED : January 5, 2010
INVENTOR(S) : Gasse et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 933 days.

Signed and Sealed this

Sixteenth Day of November, 2010

David J. Kappos

David J. Kappos
*Director of the United States Patent and Trademark Office*